US006889187B2

(12) United States Patent
Zhang

(10) Patent No.: US 6,889,187 B2
(45) Date of Patent: May 3, 2005

(54) METHOD AND APPARATUS FOR IMPROVED VOICE ACTIVITY DETECTION IN A PACKET VOICE NETWORK

(75) Inventor: Shude Zhang, Kanata (CA)

(73) Assignee: Nortel Networks Limited, St. Laurent (CA)

( * ) Notice: Subject to any disclaimer, the term of this patent is extended or adjusted under 35 U.S.C. 154(b) by 662 days.

(21) Appl. No.: 10/025,615

(22) Filed: Dec. 26, 2001

(65) Prior Publication Data

US 2002/0120440 A1 Aug. 29, 2002

Related U.S. Application Data

(60) Provisional application No. 60/304,179, filed on Dec. 28, 2000.

(51) Int. Cl.[7] ..... G10L 11/02
(52) U.S. Cl. ..... 704/253; 704/233
(58) Field of Search ..... 704/233, 253; 381/93, 103; 455/509

(56) References Cited

U.S. PATENT DOCUMENTS 5,983,114 A * 11/1999 Yao et al. ..... 455/509
6,011,853 A * 1/2000 Koski et al. ..... 381/103
2002/0071573 A1 * 6/2002 Finn ..... 381/93

OTHER PUBLICATIONS

Carleton University, Report on Voice Activity Detection for Packet Voice Transport; Dr. W.P. LeBlanc and Dr. S.A. Mahmoud, Dec. 15, 1997.

International Telecommunication Union, ITU–T G.728—Annex G, 11/94; Annex G:16 kbit/s fixed point specification.

International Telecommunication Union; ITU–T, G.723.1, Annex A; 11/96; Annex A: Silence compression scheme.

International Telecommunication Union CCITT, G.728, 09/92; Coding of Speech at 16 kbit/s using low–delay code excited linear prediction.

ETSI EN 300 973 V7.0.1 (2000–01); Digital cellular telecommunications system (Phase 2+); Half rate speech; Voice Activity Detector (VAD) for half rate speech traffic channels (GSM 06.42 version 7.0.1 Release 1998).

* cited by examiner

*Primary Examiner*—David D. Knepper
(74) *Attorney, Agent, or Firm*—John D. Crane

(57) ABSTRACT

A method and apparatus for detecting and transmitting voice signals in a packet voice network system. The method and apparatus make use of a voice activity detection (VAD) unit at a transmitter, for determining if an input signal contains active audio information or passive audio information, where the input signal includes a plurality of frames. For one or more frames of the input signal containing active audio information, the VAD computes a hangover time period. This computation includes determining whether the hangover time period has a fixed duration or a variable duration on the basis of characteristics of the active audio information contained in the one or more frames. When the VAD detects a frame containing passive audio information subsequent to the one or more frames containing active audio information, the input signal is suppressed after the expiry of the computed hangover time period from the detection of the passive audio information.

17 Claims, 8 Drawing Sheets

METHOD AND APPARATUS FOR IMPROVED VOICE ACTIVITY DETECTION IN A PACKET VOICE NETWORK

CROSS-REFERENCE TO RELATED APPLICATION

The present application claims priority from U.S. provisional application Ser. No. 60/304,179, filed Dec. 28, 2000.

FIELD OF THE INVENTION

This invention relates to the field of communication networks. It is particularly applicable to a method and an apparatus for detecting voice signals in a packet voice network.

BACKGROUND OF THE INVENTION

In recent years, the telecommunications industry has witnessed an increase in the bandwidth requirements of communication channels. This can mainly be attributed to the increasingly affordable telecommunication services as well as the increased popularity of the Internet. In a typical interaction where two users are communicating via a telephone connection, user A speaks into a microphone or telephone set connected to the public switched telephone network (PSTN). The speech signal is digitised and sent over the telephone lines to a switch. At the switch, the speech is encoded and then divided into blocks for transmission. IP packets and ATM cells are examples of protocols used to create such blocks. These protocols are well known in the art of data transmission. The blocks are transmitted over the communication channel to a receiver switch that takes the blocks and rebuilds the speech signal according to the appropriate protocol. The rebuilt speech is then synthesised at the headset of a user B communicating with the user A.

In a full-duplex conversation where information is simultaneously transmitted in both directions over a two-way channel, a large proportion of the conversation in any one direction is idle or silent. This results in a significant waste of bandwidth since a large portion of this bandwidth is used to transfer silence signals instead of using it to transmit useful information.

Commonly, in order to improve bandwidth usage, transmission of blocks is interrupted during silent or inactive periods. With a high aggregate data rate, the use of statistical multiplexing in combination with the interruption of transmission of the silence blocks can lead to a higher number of users and/or an increase in data throughput for a given communication link. At the receiver end, data representative of silence blocks can be used to "fill-in" the gaps where silence blocks would otherwise occupy.

In addition to the primary talker on either end of the communication channel, there could be a significant amount of background noise, such as car noise, street noise, multiple background talkers, background music, background office noise and many others. Unfortunately, the silence blocks, typically designed to represent white noise, do not well mimic the background noise present when the primary speakers are talking. This results in silence periods at the receiver end where the background noise is different from the background noise when the speaker is speaking, often aggravating for the users of the communication service since the sounds they are hearing are disjointed.

One way to improve the performance of such system is to transmit some blocks of silence information to allow the receiver to better mimic the background noise. In this regard the reader may wish to consult the ITU standard G.729 Annex B and G.723.1 Annex A for more information. The content of the above documents is hereby incorporated for reference.

A deficiency of the above described systems is that they are typically designed for the worst case background noise level, thus transmitting silence blocks for a sufficiently long time duration to allow the receiver to mimic the worst case background noise situation. However, the background noise is most often quiet. This results in lost bandwidth for the transmission of silence blocks that do not carry valuable information.

Another solution is proposed in the co-pending patent application Ser. No. 09/218,009 of W. P. LeBlanc and S. A. Mahmoud, filed on Dec. 22, 1998 and assigned to Nortel Networks Corporation. LeBlanc et al. teach a voice activity detector (VAD) that implements a novel variable hangover algorithm based on input signal characteristics. More specifically, the voice activity detector observes whether a signal conveys active audio information, such as speech, or passive audio information, such as silence or regular background noise, and implements a hangover period of variable duration that dynamically determines how much signal information needs to be sent over the communication channel when the signal contains passive audio information. In general, when the signal contains only silence the hangover period is short since no information is required at the other end of the communication channel. On the other hand when background noise is present, some signal information is sent over the channel to provide enough data permitting to properly train a comfort noise generator that can then synthesize the background noise.

Compared to the traditional fixed hangover algorithm, the variable hangover algorithm proposed by LeBlanc et al. balances the risk of clipping the low-energy end of speech against the risk of excessive hangover due to classification of noise as speech. Accordingly, the variable-duration hangover algorithm provides a better trade off between speech quality and bandwidth efficiency than the fixed-duration hangover algorithm. Unfortunately, the invention of LeBlanc et al. exhibits certain weaknesses. Implementation of the variable hangover period taught by LeBlanc et al. has been found to result in the unwelcome occurrence of signal clipping in certain instances, generally aggravating to the users of the communication service. In particular, the clipping of low-energy speech endings with slightly longer unvoiced sounds was detected, where such unvoiced sounds include speech segments containing fricatives or sibilants. In a specific example, repeated clipping of the ending of the word "six" was perceived, "six" having the end of two unvoiced sounds [ks], [k] being a fricative and [s] being a sibilant.

Accordingly, there exists a need in the industry for an improved method and apparatus for detecting voice signals in a packet voice network, in order to improve speech quality and maximize bandwidth usage.

SUMMARY OF THE INVENTION

The present invention provides an improved voice activity detector (VAD) that can be used in a voice signal processing equipment such as a transmitter or a receiver in a telecommunications network. The voice activity detector processes an input signal containing audio information and outputs a signal that toggles between at least two states, namely a first state and a second state. The input signal includes a plurality of frames, each frame containing either one of active audio information, such as speech, and passive audio information, such as silence or regular background noise. The first state indicates that the current input signal conveys active audio information, while the second state indicates that the current input signal conveys passive audio information. For one or more frames of the input signal containing active audio information, the voice activity detector computes a hangover time period. This computation includes determining whether the hangover time period has a fixed duration or a variable duration on the basis of characteristics of the active audio information contained in the one or more frames. When the voice activity detector detects a frame containing passive audio information subsequent to the one or more frames containing active audio information, the voice activity detector switches the output signal to the second state after the expiry of the computed hangover time period from the detection of the frame containing passive audio information.

The output signal generated by the voice activity detector can be used to control the transmission of data frames from the input signal over a communication channel. More specifically, when the signal is in the first state (active audio information) the frames are sent. Here, by "active audio information" is meant information such as speech that must be sent in the communication channel in order to be made available at the other end of that channel. When the signal is in the second state (passive audio information) little or no frames are sent. Here, by "passive audio information" is meant information that does not need to be completely sent through the communication channel. For example, when the input signal contains silence, this constitutes passive audio information since nothing needs to be sent through the communication channel in order to obtain silence at the other end. Similarly, background noise is passive audio information since only a sample of that information needs to be sent through the channel in order to train a comfort noise generator to synthesize the background noise.

The variable-duration hangover period determines how much input signal information needs to be sent over the communication channel when the input signal contains passive audio information. In general, when the input signal contains only silence, the hangover period is very short since no information is required at the other end of the communication channel. On the other hand, when background noise is present, some signal information is sent over the channel to provide enough data permitting to properly train a comfort noise generator that can then synthesize the background noise.

The voice activity detector keeps track of the duration of active speech, as well as of the minimum energy of the input signal, and dynamically adjusts the hangover period accordingly. Such active speech is also referred to as a burst of speech. In a specific, non-limiting example of implementation, a burst threshold is representative of the minimum length of a normal speech burst. When the duration of a speech burst is greater than the burst threshold, the duration of the hangover period is set to a value x, where x is variable and dynamically adjusted in a linear relationship with the estimated background noise level. When the duration of a speech burst is less than the burst threshold, the duration of the hangover period is set to a fixed, constant value y, thus providing for the possibility of abnormal speech bursts characterized by a length that is less than the predetermined burst threshold.

Thus, the voice activity detector employs a fixed-duration hangover period for an abnormal speech burst duration that is less than the burst threshold, in addition to a variable-duration hangover period for the normal speech burst duration. The distinction between a "normal" and an "abnormal" speech burst is defined by the burst threshold, an experimentally derived value.

Advantageously, the voice activity detector of the present invention improves on the prior art device by reducing signal clipping, such as the clipping of low-level endings of speech bursts with slightly longer unvoiced sounds. The improved voice activity detector also ensures that the appropriate amount of input signal information is sent over the communication channel when the input signal contains passive audio information. Thus, speech quality is improved and the bandwidth usage over the communication channel is maximized.

Note that the value of the burst threshold and the duration y of the fixed-duration hangover period are determined on a basis of the signal clipping behavior exhibited by the voice activity detector in a real-time environment.

BRIEF DESCRIPTION OF THE DRAWINGS

These and other features of the present invention will become apparent from the following detailed description considered in connection with the accompanying drawings. It is to be understood, however, that the drawings are provided for purposes of illustration only and not as a definition of the boundaries of the invention for which reference should be made to the appending claims.

DETAILED DESCRIPTION

Figure 1:
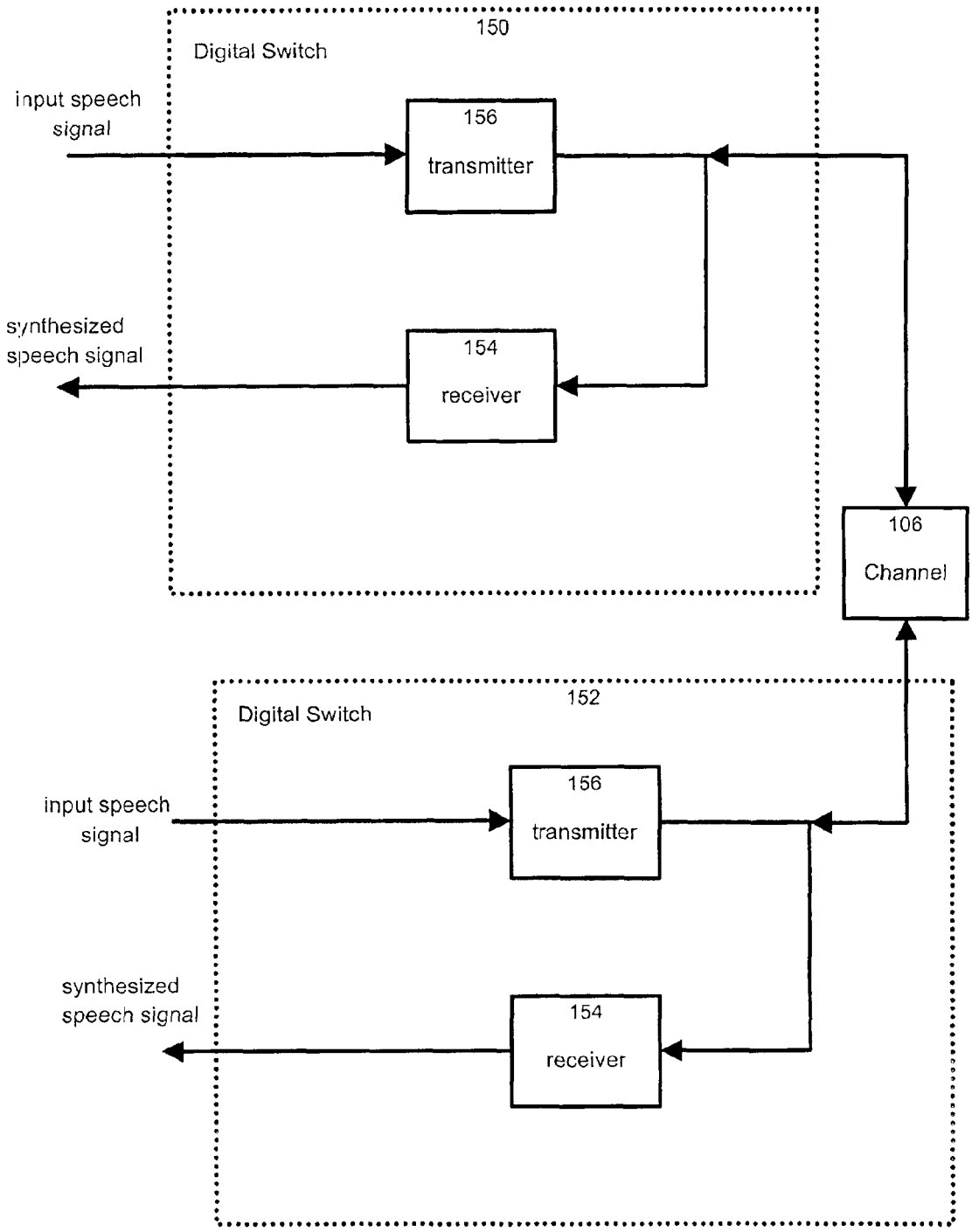
FIG. 1 shows a simplified functional block diagram of a packet voice network, in accordance with an example of implementation of the present invention.

FIG. 1 is a block schematic diagram of a communication network including a packet voice network system, according to an example of implementation of the invention. The packet voice network system is integrated with telephone switches 150 and 152 that are part of a public switched telephone network (PSTN). The switches are connected to a bi-directional communication channel 106, such as a T1 or T3 trunk optical cable or any other suitable communication channel including radio frequency channels. The protocol on the channel may be ATM (Asynchronous Transfer Mode), frame relay or IP (Internet Protocol). Other suitable protocols may be used here without detracting from the spirit of the invention. Each switch 150, 152 includes a packet voice network system comprising a receiver unit 154 and a transmitter unit 156. The transmitter unit 156 has an input for receiving an input speech signal from a telephone line and an output connected to the communication channel 106. The receiver unit 154 has an input for receiving data from the communication channel 106 and an output for outputting a synthesized speech signal to the telephone line.

Note that, alternatively, each of switches 150 and 152 may be connected to a packet voice network system comprising a receiver unit 154 and a transmitter unit 156, where the packet voice network system is not necessarily implemented within the switch itself.

Figure 2:
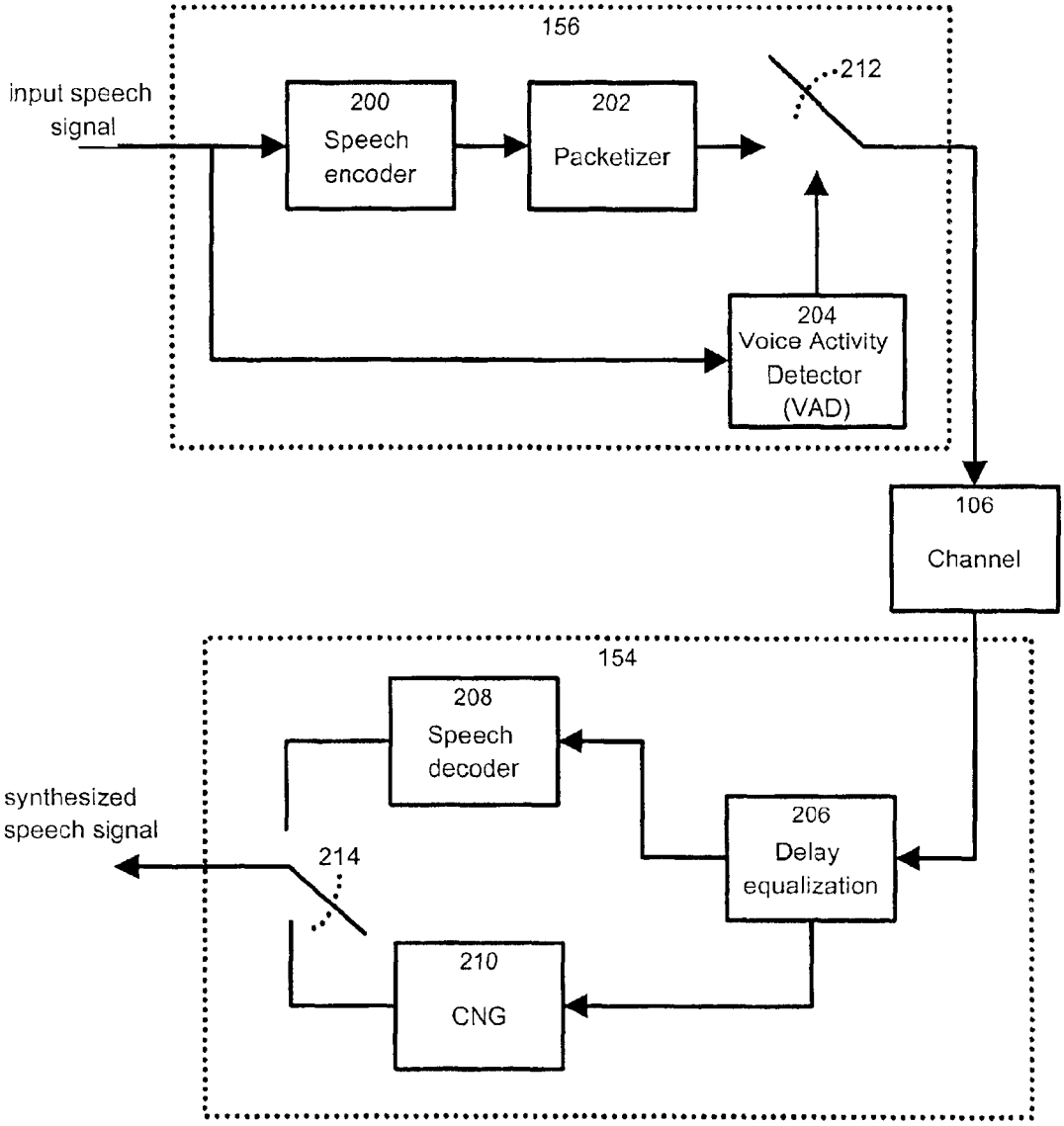
FIGS. 2 and 3 show block diagrams of a transmitter/receiver pair, in accordance with an example of implementation of the invention.

FIG. 2 is a block schematic diagram that illustrates the signal transmitter unit 156 and the receiver unit 154 in greater detail, according to a specific, non-limiting example of implementation. The signal transmitter unit 156 comprises a speech encoder unit 200, a packetizer unit 202, a voice activity detector (VAD) 204 and a transmission switch 212. The speech encoder unit 200 receives the input speech signal. The output of the speech encoder unit 200 is connected to the input of the packetizer unit 202. The voice activity detector 204 receives the same input speech signal as the speech encoder unit 200. The output of the packetizer unit 202 and the output of the VAD 204 are connected to the transmission switch 212. The transmission switch 212 can assume one of two operative modes, namely a first operative mode wherein information packets are transmitted to the communication channel 106 and a second operative mode wherein packet transmission is interrupted.

Figure 3:
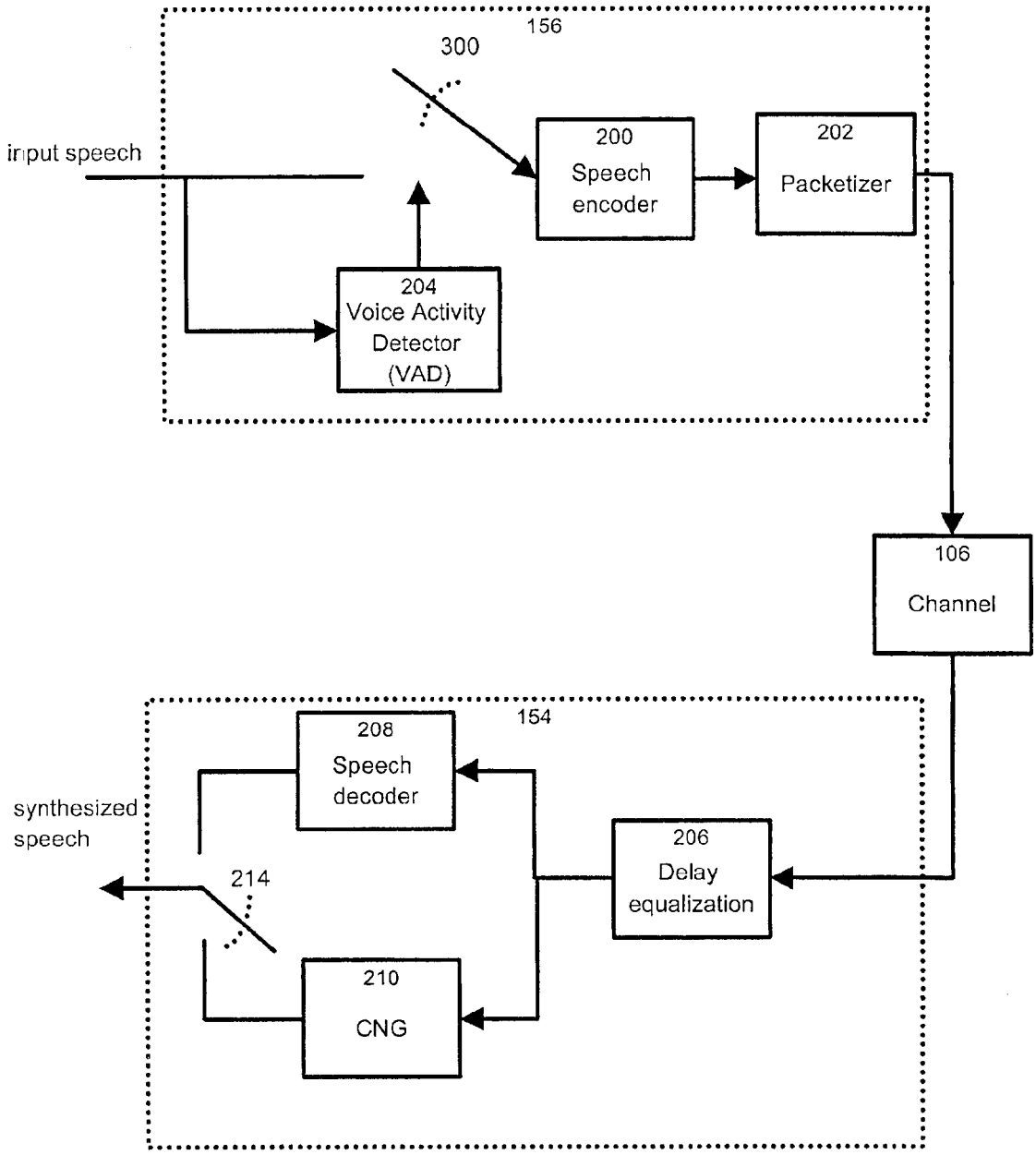

In a variant, as shown in FIG. 3, the communication channel carrying the input speech signal, which may be a telephone line, is connected to the inputs of the transmission switch 300 and the voice activity detector 204. The output of the transmission switch 300 is connected to the speech encoder unit 200, where the transmission switch 300 can assume either one of a first and second operative mode. In the first operative mode, input speech is transmitted to the speech encoder unit 200. In the second operative mode, transmission of the input speech signal is interrupted. The output of the voice activity detector 204 is connected to the transmission switch 300 and allows the suppression of the input speech signal to the speech encoder unit 200.

In the example of implementation shown in FIG. 2, as well as in the variant shown in FIG. 3, the signal receiver unit 154 of the packet voice network system comprises a delay equalization unit 206, a speech decoder unit 208, a comfort noise generation (CNG) unit 210 and a selection switch 214. The delay equalization unit 206 is connected to the communication channel 106 and receives information packets. The speech decoder unit 208 is connected to a first output of the delay equalizer unit 206. The comfort noise generation (CNG) unit 210 is connected to a second output of the delay equalization unit 206. The output of the speech decoder unit 208 and the output of the CNG unit 210 are connected to the selection switch 214. The selection switch comprises an output to a communication link such as a telephone line or other suitable link. The selection switch 214 can assume one of two operative modes, namely a voice transmission operative mode and a comfort noise transmission operative mode. In the voice transmission operative mode, the output of the speech decoder unit 208 is transmitted to the output of the selection switch 214. In the comfort noise transmission operative mode, the output of the CNG unit 210 is transmitted to the output of the selection switch 214.

The VAD unit 204 suppresses frames of the input signal containing background noise or silence. Preferably, the VAD 204 allows a few frames containing background noise or silence to be transmitted to the receiver 154 in the form of Silence Insertion Descriptor (SID) packets. The SID packets contain information that allows the CNG unit 210 to generate a signal approximating the background noise at the transmitter input.

In a particular example, SID packets carry compressed speech, where a short segment of the noise is transmitted to the receiver 154 in a SID packet. The background noise data in the SID packets is encoded in the same manner as speech. The encoded background noise in the SID packets is played out at the receiver 154 and used to update the comfort noise parameters.

In an alternative example, no SID packets are transferred from the transmitter unit 156 and the receiver 154 estimates the comfort noise parameters based on received data packets. Under this alternative example, the receiver 154 includes a VAD coupled to the CNG unit 210 and the speech decoder unit 208 to determine which frames are non-active. The VAD passes these non-active frames to the CNG unit 210. The CNG unit 210 generates background noise on the basis of a set of parameters characterizing the background noise at the transmitter 156 when no data packets are received in a given frame. The non-active speech packets received are used to update the comfort noise parameters of the CNG unit 210. Preferably, the transmitter 156 sends a few frames of silence (or non-active speech), during a variable length hangover period, most likely at the end of each talk spurt. This will allow the VAD, and therefore the CNG unit 210, to obtain an estimate of the background noise at the speech decoder unit 208.

In yet another alternative example, SID packets carry background noise energy information. In this method, SID packets are sent, and the SID packets contain mainly the background noise energy values. The noise during the period in which silence is suppressed is encoded as a single power value. In yet one other alternative example, SID packets carry both background noise energy information and a spectral estimate.

The receiver unit 154 receives packets from the transmitter unit 156 via the communication channel 106 and outputs a reconstructed synthesized speech output signal. The signal received from the channel 106 is first delay equalized in the delay equalization unit 206. Delay equalization is a method used to remove in part delay distortion in the transmitted signal due to the channel 106. Delay equalization is well known in the art to which this invention pertains and will not be described in further detail. The delay equalization unit 206 outputs a delay-equalized signal.

The output of the delay equalization unit 206 is coupled to the input of the speech decoder unit 208. The speech decoder unit 208 receives and decodes each packet on a basis of the protocol in use, examples of which include the CELP protocol and the GSM protocol. The output of the delay equalization unit 206 is also coupled to the input of the CNG 210.

Figure 7:
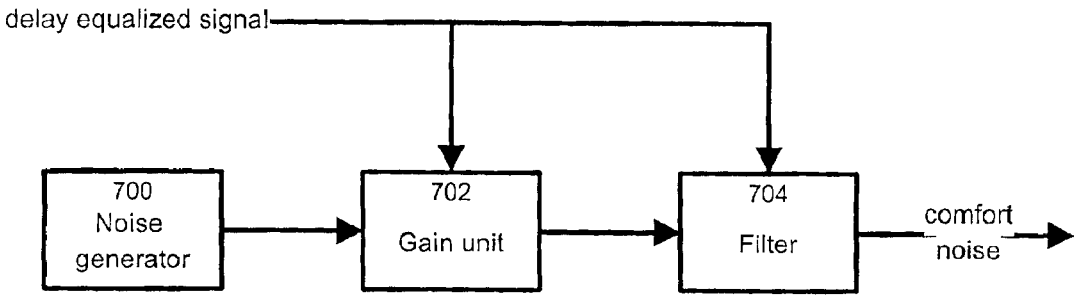
FIG. 7 is a block diagram of the comfort noise generator (CNG) shown in FIG. 2, in accordance with an example of implementation of the invention.

The CNG unit 210, as shown in FIG. 7, comprises a noise generator 700, a gain unit 702 and a filter unit 704. In a specific example, the noise generator 700 produces a white noise signal. The gain unit 702 receives the noise signal generated by the noise generator 700 and amplifies it according to the current state of the background noise. Preferably, the gain amount is determined on the basis of the SID packets received from the signal transmitter unit 156. Alternatively, the gain value can be estimated on the basis of the silence packets received from the signal transmitter unit 156. The gain unit 702 outputs an amplified signal. Note that the amplified signal may be of lesser magnitude than the signal originally generated by the noise generator 700 without detracting from the spirit of the invention. The amplified signal is then passed through the filter unit 704. In a specific example, the filter unit 704 is an all-pole synthesis filter. Preferably, the filter unit 704 receives filter parameters in the form of SID packets. These filter parameters are stored in the filter unit 704 for reuse in subsequent frames if no packets are received for a given frame. More specifically, if the current packet is a SID packet, the CNG unit 210 updates its comfort noise parameters and outputs a signal representative of the noise described by the new state of the parameters. If there is no packet received for a given frame, the CNG unit 210 outputs a signal representative of background noise described by the current state of the parameters.

The speech encoder unit 200 includes an input for receiving a signal potentially containing a spoken utterance. The input signal is processed and encoded into a format suitable for transmission. Specific examples of formats include CELP, ADPCM and PCM among others. Encoding methods are well known in the field of voice processing and other suitable methods may be used for encoding the input signal without detracting from the spirit of the invention. The speech encoder unit 200 includes an output for outputting an encoded version of the input speech. Preferably, during silence and hangover periods, the background noise power and background noise spectrum are computed by averaging the short-term energy and the spectrum for these periods. The averaging is accomplished by the use of a non-linear filter that has the following difference equation:

$$y(n)=(1-\beta_j)y(n-1)+\beta_j u(n)$$

where u(n) is the filter input and y[n] is the filter output.

In a specific example, the filter input u(n) is the short term energy of the speech signal and the filter coefficient $\beta_j$ is not a constant but a variable that is chosen from a set of filter coefficients. A small value is used if the energy of the current frame is 3 dB higher than the comfort noise energy level, otherwise, a slightly larger filter coefficient is used. The purpose of this method is to smooth out the resulting comfort noise. As a result, the comfort noise tends to be somewhat quieter than the true background noise.

The packetizer unit 202 is provided for arranging the encoded speech signal into packets. In a specific example the packets are IP packets (Internet Protocol). Another possibility is to use ATM packets. Many methods for arranging a signal into packets may be used here without departing from the spirit of the invention.

In FIG. 2, the VAD unit 204 receives the input speech signal as input and outputs a classification result and a hangover identifier for each frame of the input speech signal. The classification result controls the switch 212 in order to transmit the packets generated by the packetizer unit 202 if the input signal is active audio information or to stop the transmission of packets if the input speech is passive audio information.

Figure 4:
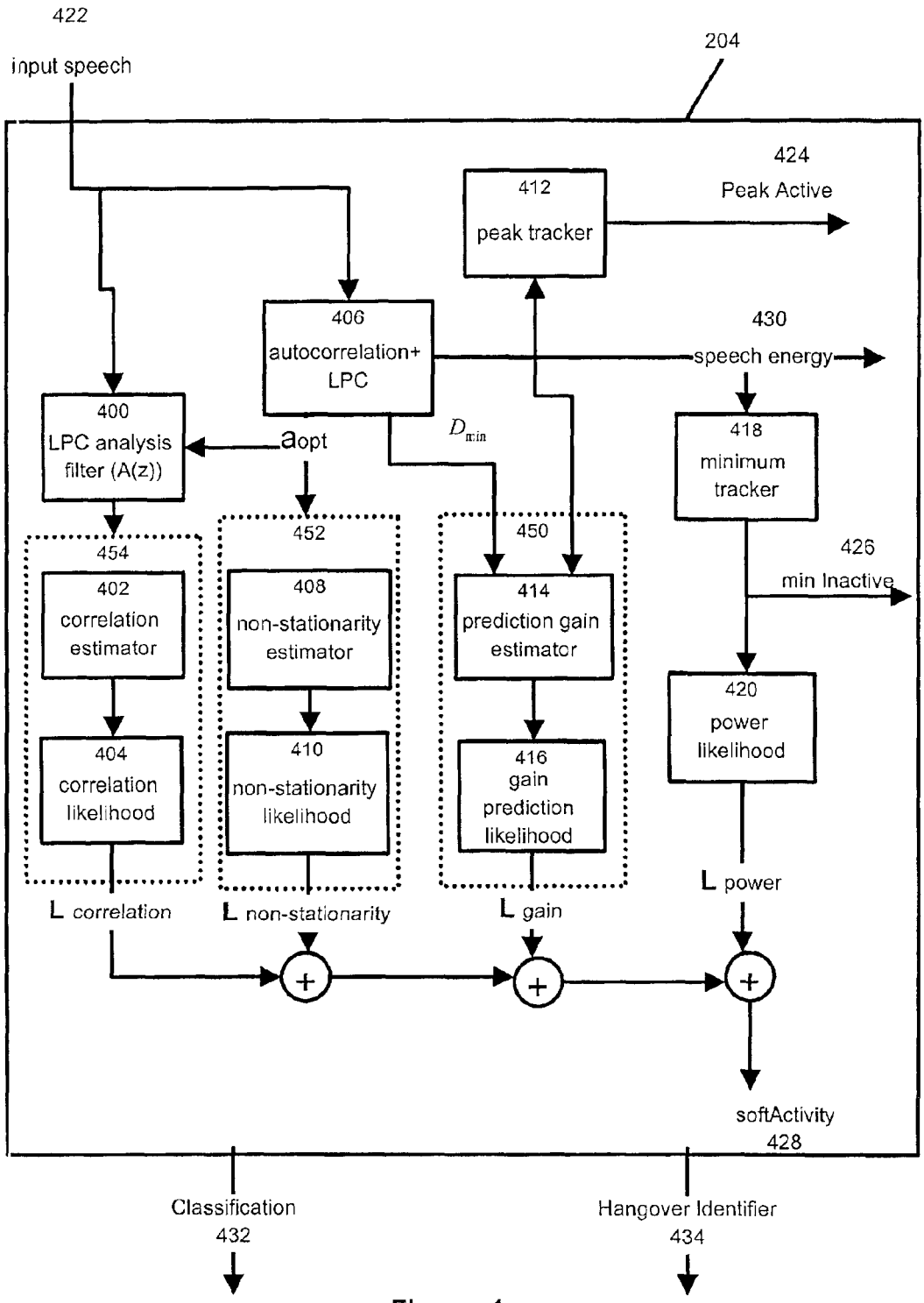
FIG. 4 is a functional block diagram illustrating an example of implementation of the voice activity detector unit shown in FIG. 2.

FIG. 4 is a block schematic diagram that illustrates a specific, non-limiting example of implementation of the voice activity detector 204 of the signal transmitter unit 156. The VAD 204 comprises an input for receiving a speech signal 422, a peak tracker unit 412, a minimum energy tracker 418, a prediction gain test unit 450, a stationarity test unit 452, a correlation test unit 454, LPC computational units 400 and 406 and a power test unit 420. The correlation test unit 454 and the prediction gain test unit 450 may be omitted from the VAD 204 without detracting from the spirit of the invention. The VAD 204 also includes a first output for outputting a classification signal 432 which controls the switch 212 and a second output for outputting a hangover identifier signal 434 which identifies the presence of a hangover state.

Figure 6:
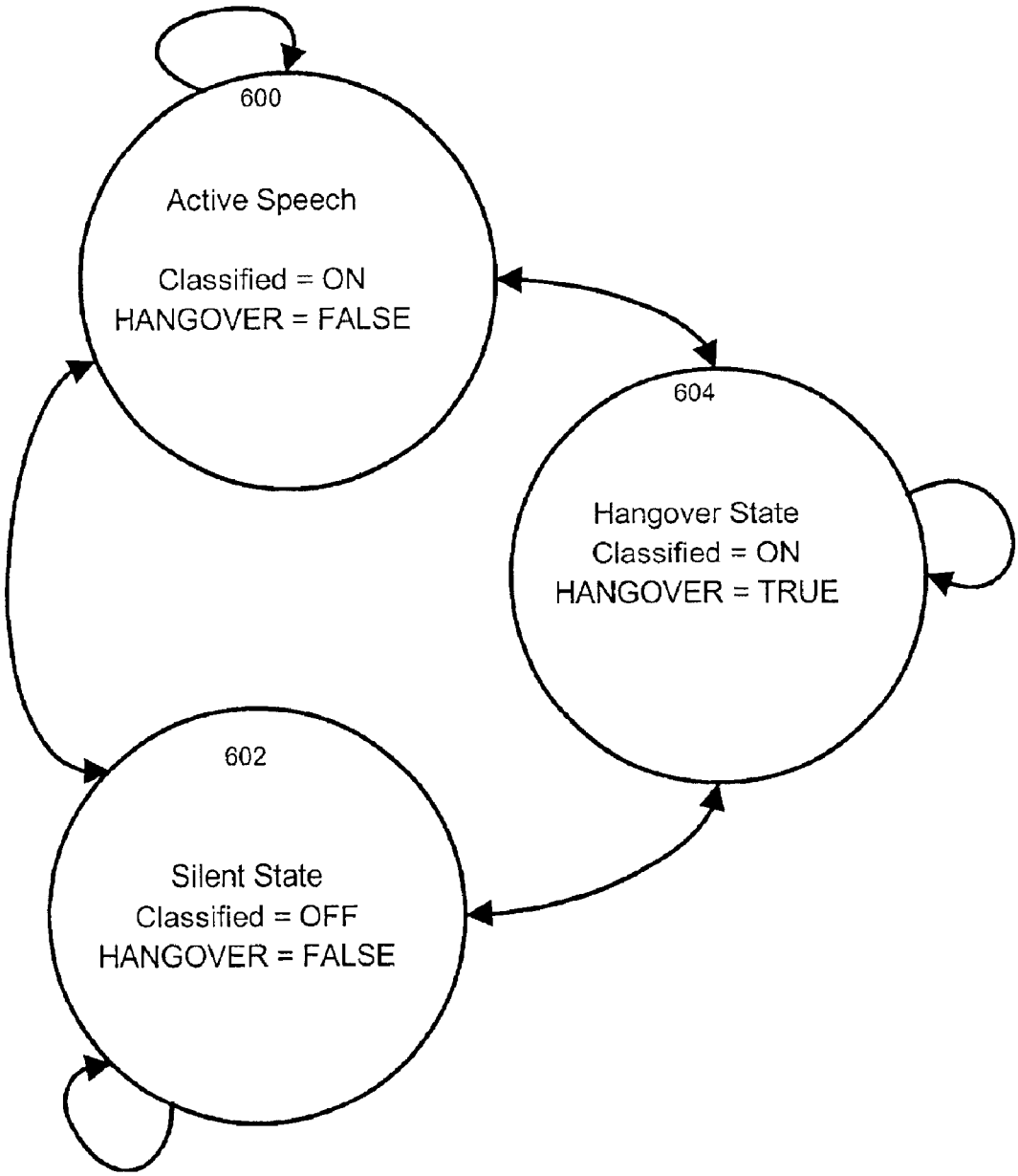
FIG. 6 is a state diagram of the voice activity detector of FIG. 4, in accordance with an example of implementation of the invention.

The classification result 432 and the hangover identifier signal 434 are generated by the VAD 204 on the basis of the characteristics of the input speech signal. As shown in FIG. 6, the classification result 432 and the hangover identifier 434 define a set of states that the VAD 204 may acquire, namely the active speech state 600, the hangover state 604 and the silent state 602. In the active state 600, the input signal contains active audio information and the speech packets are sent to the signal receiver unit 154 through the communication channel 106. In this state, the output of the VAD 204 indicates that the current frame has been classified as ON (active) and that the frame is an active audio information frame (hangover=FALSE). In the hangover state 604, the input signal may include weak speech information and/or some background noise. When the VAD 204 is in the hangover state, SID packets may be sent to the signal receiver unit 154 through the communication channel 106. In this state, the output of the VAD 204 indicates that the current frame has been classified as ON (active) and that the frame is indicative of background noise and/or weak speech information (hangover=TRUE). The hangover state 604 is a transition state between the active speech state 600 and the silence state 602. The duration of the hangover state 604 is a function of the characteristics of the input signal. In the silent state 602, the input signal may either contain very weak background information (typically below the hearing threshold) or may have been in the hangover state long enough for packets to be suppressed by the transmitter 156 without substantially affecting the ability of the receiver 154 to fill in the missing packets with synthesized noise. In this state, the output of the VAD 204 indicates that the current frame has been classified as OFF (non-active) and that the frame contains silence or background noise (hangover=FALSE). Optionally, SID packets may be periodically transmitted during this state 602 if the background noise changes appreciably. The state where the current frame has been classified as OFF and the frame is indicative of background noise (hangover=TRUE) is not shown since the packets are not being transmitted. The output of this state (classified=OFF; hangover=TRUE) would be the same as that of state 602. SID packets may be transmitted to the receiver 154 periodically or on an as needed basis when the background noise changes appreciably. In this particular example of implementation, SID packets are sent at the end of the hangover period, during the transition from the hangover state 604 to the silent state 602.

More specifically, the VAD unit 204 performs the analysis of the input signal over frames of speech. In a specific example, frames are fairly short, at about 10 msec, and previous frames are grouped into a window of speech samples. Typically, a window is somewhat longer than a frame and may last about 20 to 30 msec. In a typical interaction the input speech 422 is segmented into frames of N samples, and linear prediction analysis is performed on these N samples plus NP-N previous samples by the LPC auto-correlation unit 406. LPC auto-correlation unit 406 computes the predictor parameters ($a_{opt}$), the minimum mean squared error ($D_{min}$), and the speech energy 430 of the current frame. The LPC parameters computed by the LPC auto-correlation unit 406 are accumulated over several frames. These LPC parameters are used to compute the spectral non-stationarity measure and subsequently a non-stationarity likelihood in the stationary test unit 452. The minimum mean squared error ($D_{min}$) and the speech energy 430 are the inputs to the prediction gain test unit 450, used to compute the prediction gain, which is then used to obtain a prediction gain likelihood. The speech is also input into an LPC inverse filter (A(z)) 400 to obtain the residual, which is transmitted to the correlation test unit 454. Finally, a peak tracker 412 and minimum tracker 418 track the extrema of the speech power. The minimum tracker output 426 and the speech energy 430 are used to obtain the power likelihood.

The LPC analysis filter (inverse filter) unit 400 is a linear FIR filter described by the equation:

$$A(z) = 1 + \sum_{k=1}^{p} a_k z^{-k}$$

The LPC auto-correlation filter 406 is derived by solving the p-th order linear systems of equations $Ra_{opt}=-r$, where:

$$a_{opt}=R^T(-r)$$

$$D_{min}=r(0)+a_{opt}r$$

$$a=(a_1a_2 \ldots a_p)^T$$

$$r=(r_1r_2 \ldots r_p)^T$$

$$R_{i,j}=r(|i-j|),1\leq i,\ j\leq p$$

In the above equations, r(j) is the auto-correlation of the windowed input speech at lag j and r(0) is the speech energy. The window duration is NP, and the window shape is a hamming window. In order to ensure stability of the algorithms to solve the system of equations ($Ra_{opt}=-r$), there may be further conditioning on R and r.

The peak tracker unit 412 uses a simple non-linear first order filter. The input of the peak tracker unit 412 is the energy of the speech signal. Optionally, the peak tracker unit 412 has a coefficient dependent on the state of the VAD unit 204. Mathematically, this can be expressed by the following formula:

$$y(n)=\max(u(n),(1-\alpha)y(n-1)+\alpha u(n))$$

where u(n) is the input speech energy over the current frame, y(n) is the output of the peak tracker unit 412 and α is the time constant value. In a specific example, α is selected from a set of two possible constant values. The larger value is used if the frame is declared active, otherwise the smaller value is used. In a specific example, the value of α is selected from the set {0.03, 0.06}. The larger value of α is used if the input is classified as active, otherwise the smaller value of α is used. In this manner, the filter tends to track the peaks of the waveform. Under certain circumstances, the peak tracker output may be held constant, for example, if the current energy is below the threshold of hearing.

The minimum energy tracker 418 identifies frames where the energy of the input signal is low, using a simple non-linear first order filter. Optionally, the minimum tracker 418 has a coefficient dependent on the state of the VAD unit 204. Mathematically, this can be expressed by the following formula:

$$y(n)=\min(u(n),(1-\alpha)y(n-1)+\alpha u(n))$$

where u(n) is the input speech energy over the current frame, y(n) is the output of the minimum energy tracker 418 and α is the time constant value. In a specific example, α is selected from a set of two possible constant values. The smaller value is used if the frame is declared active, otherwise the larger value is used. In a specific example, the value of α is selected from the set {0.03, 0.06}. The larger value of α is used if the frame is classified as inactive, otherwise the smaller value of α is chosen. In this manner, the filter tends to track the minima of the waveform. Under certain circumstances, the minimum energy tracker 418 output may be held constant, for example if the current energy is below the threshold of hearing or if the speech energy is fluctuating appreciably. As will be described in further detail below, the output y(n) of the minimum energy tracker 418 during the period of a normal speech burst is used by the VAD 204 to dynamically set up the duration of the variable-duration hangover period. Note that this setting of the variable-duration hangover period occurs just prior to the VAD 204 entering the hangover state 604.

The power test unit 420 computes a power likelihood value indicative of the likelihood that the current frame satisfies the power criterion for active speech. In a specific example, the power likelihood is computed based on the value of the speech energy of the current frame and two thresholds, namely a minimum threshold and a maximum threshold. The two thresholds are used to produce a crude probability or likelihood of an active speech segment for a particular parameter. Given the pair of thresholds ($th_{0\text{-}power}$, $th_{1\text{-}power}$) and the parameter of interest (x), the likelihood are computed as follows:

$$L_{power} = \begin{cases} 0 & x \leq th_{0-power} \\ 1 & x \geq th_{1-power} \\ \dfrac{x - th_{0-power}}{th_{1-power} - th_{0-power}} & \text{otherwise} \end{cases}$$

In a specific example, the minimum and maximum thresholds are set on the basis of the peak active value 424 and the minimum inactive value 426. Alternatively, the power lower and upper thresholds are set to predetermined values. Other methods may be used to compute the power likelihood without detracting from the spirit of the invention.

The VAD unit 204 also includes a prediction gain test unit 450. The prediction gain test unit 450 provides a likelihood estimate related to the amount of spectral shape or tilt in the input speech signal 422, and includes a prediction gain estimator 414 and a gain prediction likelihood unit 416.

The prediction gain estimator 414 computes the prediction gain of the signal over a set of consecutive frames. In a specific example, the computation of the prediction gain is a two step operation. As a first step, the residual energy is computed over a window of the speech signal. The residual energy is the energy in the signal obtained by filtering the windowed speech through an LPC inverse filter.

Mathematically, the residual energy is:

$$D=r(0)+2a^Tr+a^TRa$$

where:

$$a=(a_1a_2 \ldots a_p)^T$$

$$r=(r_1r_2 \ldots r_p)^T$$

$$R_{i,j}=r(|i-j|),\ 1\leq i,j\leq p$$

In the above equations, r(j) is the auto-correlation of the input windowed speech at lag j.

Following this first step, the prediction gain is computed. In a specific example, the prediction gain is simply r(0)/D and is usually converted to a dB scale. For the optimal LPC inverse (i.e., $Ra_{opt}=-r$), simple substitution into the previous equation leads to:

$$D_{min}=r(0)+a_{opt}^{T}r$$

where $D_{min}$ is received from block 406. The prediction gain is $G=r(0)/D_{min}$ and is computed by the prediction gain estimator 414. Typically, if the prediction gain is very large, it implies that there are very strong spectral components or there is considerable spectral shape or tilt. In either case, it is usually an indication that the signal is voice or a signal which may be hard to regenerate with comfort noise.

The gain prediction likelihood unit 416 outputs a likelihood that a frame of the speech signal satisfies the prediction gain criterion for active speech. In a specific example, the prediction gain likelihood is computed based on the value of the prediction gain of the current frame and two thresholds, namely a minimum threshold and a maximum threshold. The two thresholds are used to produce a crude probability or likelihood of an active speech segment for a particular parameter. Given the pair of thresholds ($th_{0\text{-}gain}$,$th_{1\text{-}gain}$) and the parameter of interest (x), the likelihoods are computed as follows:

$$L_{gain}=\begin{cases}0 & x\le th_{0-gain}\\ 1 & x\ge th_{1-gain}\\ \dfrac{x-th_{0-gain}}{th_{1-gain}-th_{0-gain}} & \text{otherwise}\end{cases}$$

In a specific example, the prediction gain lower and upper thresholds are selected on the basis of empirical tests. Other methods may be used to compute the prediction gain likelihood without detracting from the spirit of the invention.

The VAD 204 further includes a correlation test unit 454 that computes a likelihood that the pitch correlation of the speech signal is representative of active speech. Preferably, the correlation test unit 454 comprises two modules, namely a correlation estimator 402 and a correlation likelihood computation unit 404.

The residual signal is obtained by taking the input frame of speech and filtering it through the LPC inverse filter (A(z)) 400. The output of the inverse filter 400 is:

$$d(j)=s(j)+\sum_{k=1}^{p}a(k)s(j-k)\forall\ 0\le j<n$$

where s(j) is the input signal, n is the frame size, p is the LPC model order and d(j) is the output of the LPC inverse filter 400 for the $j^{th}$ sample in the frame. During voice periods of speech, there is often periodicity at lags corresponding to the pitch period of the voiced speech. The long-term predictor is computed by the correlation estimation unit 402. Mathematically, in a specific example, this unit 402 is a first order predictor and can be expressed as:

$$B(z)=1-bz^{-M}$$

The pitch (or long term) residual, e(j), is simply d(j) filtered through the correlation estimation unit 402 B(z):

$$e(j)=d(j)-bd(j-M)$$

where both b and M are determined by minimizing the pitch (or long term) residual e(j) over a block of n samples:

$$E=\sum_{j=0}^{n-1}e^2(j)=\sum_{j=0}^{n-1}(d(j)-bd(j-M))^2$$
$$=\sum_{j=0}^{n-1}d^2(j)-2b\left(\sum_{j=0}^{n-1}d(j)d(j-M)\right)+b^2\sum_{j=0}^{n-1}d^2(j-M)$$

For a particular value of M, minimizing with respect to b leads to:

$$b=\frac{\sum_{j=0}^{n-1}d(j)d(j-M)}{\sum_{j=0}^{n-1}d^2(j-M)}$$

Substituting b back into the equation for E above (and normalizing by dividing by $D_u$) leads to:

$$\frac{E}{D_u}=1-\frac{\left(\sum_{j=0}^{n-1}d(j)d(j-M)\right)^2}{\left(\sum_{j=0}^{n-1}d^2(j-M)\right)\left(\sum_{j=0}^{n-1}d^2(j)\right)}$$

where $D_u$ is the unwindowed residual energy:

$$D_u=\sum_{j=0}^{n-1}d^2(j)$$

Minimizing $E/D_u$ for a particular value of M, is equivalent to maximizing $1-E/D_u$. To minimize/maximize over all M, values of M are attempted over a reasonable range of M. In a specific example, values of M between mmin=18 and mmax=147 are used. Preferably, the maximum pitch correlation (corresponding to the minimum pitch residual e(j)) is averaged over a set of frames. The average pitch correlation is simply obtained by averaging the maximum pitch correlation found over all M over the past few frames. The average squared normalized pitch correlation is the output of the correlation estimator 402.

The pitch correlation tends to be high for voiced segments. Thus, during voiced segments, the normalized squared correlation will be large. Otherwise it should be relatively small. This parameter can be used to identify voiced segments of speech. If this value is large, it is very likely that the segment is active (voiced) speech.

The correlation likelihood unit 404 receives the correlation estimate from the correlation estimator 402 and outputs a likelihood that a frame of the speech signal satisfies the correlation criterion for active speech. In a specific example, the correlation likelihood is computed based on the value of the correlation of the current frame (or the average over the past few frames) and two thresholds, namely a minimum threshold and a maximum threshold. The two thresholds are used to produce a crude probability or likelihood of an active speech segment for the correlation. Given the pair of thresholds ($th_{0\text{-}correlation}$, $th_{1\text{-}correlation}$) and the parameter of interest (x), the likelihood is computed as follows:

$$L_{correlation} = \begin{cases} 0 & x \le th_{0-correlation} \\ 1 & x \ge th_{1-correlation} \\ \dfrac{x - th_{0-correlation}}{th_{1-correlation} - th_{0-correlation}} & \text{otherwise} \end{cases}$$

In a specific example, the correlation likelihood thresholds are set on the basis of empirical tests. Other methods may be used to compute the correlation likelihood without detracting from the spirit of the invention.

The VAD 204 also includes a stationarity test unit 452. In a specific example, the background noise is assumed to be substantially stationary. Spectral non-stationarity is a way of identifying speech over non-speech events. The stationarity test unit 452 outputs a likelihood estimate reflecting the degree of non-stationarity in each frame of the input speech signal 422. In a specific example, spectral non-stationarity is measured using the likelihood ratio between the current frame of speech using the LPC model filter derived from the current frame of speech and the LPC model filter derived from a set of past frames in the signal. Mathematically, spectral non-stationarity is measured using an LPC distance measure computed by block 408. The likelihood ratio may be expressed as follows:

$$d_{LR}(R, r, a) = \frac{r(0) + 2a^T r + a^T Ra}{r(0) + a_{opt}^T r}$$

where:

$$a=(a_1 a_2 \ldots a_p)^T$$

$$r=(r_1 r_2 \ldots r_p)^T$$

$$R_{i,j-r}(|i-j|), 1 \le i,j \le p$$

In the above equations, $a_{opt}$ is the minimum residual energy predictor computed in block 406. The predictor a, in this case, is the optimal predictor computed over a set of past frames. If the likelihood ratio is large, it is an indication that the spectrum is changing rapidly. Assuming the noise is relatively stationary, spectral non-stationarity is an indication of active speech. The log-likelihood ratio is just:

$$d_{LLR}(R,r,a)=10 \log_{10}(d_{LR}(R,r,a))$$

Many of the parameters above are computed in a conventional speech coder (such as ITU-T international standards G.728, G.723.1 and G.729, European standards GSM and GSM-EFR, etc). Other methods of evaluating the stationarity of the input signal may be used without detracting from the spirit of the invention, provided that a suitable method of spectral distance is used.

The non-stationarity likelihood unit 410 outputs a likelihood that a frame of the speech signal satisfies a non-stationarity criterion for active speech. In a specific example, the non-stationarity likelihood is computed based on the value of the non-stationarity value computed by the non-stationarity estimator and two thresholds, namely a minimum threshold and a maximum threshold. The two thresholds are used to produce a crude probability or likelihood of an active speech segment for the non-stationarity criterion. Given the pair of thresholds ($th_{0-non-stationarity}$, $th_{1-non-stationarity}$) and the parameter of interest (x), the likelihood is computed as follows:

$$L_{non-stationarity} = \begin{cases} 0 & x \le th_{0-non-stationarity} \\ 1 & x \ge th_{1-non-stationarity} \\ \dfrac{x - th_{0-non-stationarity}}{th_{1-non-stationarity} - th_{0-non-stationarity}} & \text{otherwise} \end{cases}$$

In a specific example, the non-stationarity likelihood thresholds are set on the basis of empirical tests. Other methods may be used to compute the non-stationarity likelihood without detracting from the spirit of the invention.

The correlation likelihood ($L_{correlation}$), non-stationarity likelihood ($L_{non-stationarity}$), prediction gain likelihood ($L_{gain}$) and power likelihood ($L_{power}$) are all added to obtain the composite soft activity value 428. The composite soft activity value 428, along with the speech energy 430, the output of the peak tracker 424 and the output of the minimum tracker 426 are used to classify the input speech for the current frame in the active state, hangover state or silent state. If the classification result 432 indicates that the current frame is active speech, the VAD output signal causes the switch 212 to be in a position that allows the speech packets to be transmitted. Alternatively, if the classification result 432 indicates that the current frame is not active speech, the VAD output signal causes the switch 212 to be in a position that does not allow the speech packets to be transmitted.

In addition to the classification result 432, the VAD 204 outputs a second signal, herein designated as the hangover identifier 434, indicative of the presence of a hangover state. More specifically, the hangover identifier 434 is indicative of a transition between the active state and the silent state. Preferably, the hangover identifier 434 is appended to the packets being transmitted to the signal receiver unit 154. In a specific example, for each frame of the speech signal, the hangover identifier 434 may take one of two states, indicating either that the hangover state is ON or that the hangover state is OFF.

The duration of the hangover period, during which the packets containing passive audio information are being transferred, is either variable or fixed, depending on the duration of active speech detected by the VAD 204. The VAD 204 detects active speech, as well as its duration, on the basis of various parameters and thresholds, as discussed above and to be described in further detail below. Note that active speech may also be referred to as a burst of speech, under certain conditions also to be discussed below. By keeping track of the duration of the speech burst, the variable-duration hangover period and the fixed-duration hangover period can be adjusted dynamically in order to improve the speech quality of the voice activity detection performed by the VAD 204.

Specific to the present invention, the duration of the hangover period is set to a fixed, constant value y when the input speech burst exhibits one or more abnormal characteristics. Such abnormal characteristics are typically identified in speech bursts of short duration and low-energy, for example speech bursts having low-energy ending portions that include slightly longer unvoiced sounds, such as fricatives [k] and sibilants [s]. In the specific example of implementation described herein, the abnormal characteristic is a speech burst duration that is less than a burst threshold, where this burst threshold is an experimentally derived value.

Thus, the VAD 204 employs a fixed-duration hangover period for an abnormal speech burst duration that is less than the burst threshold, in addition to a variable-duration hangover period for the normal speech burst duration. The distinction between a "normal" and an "abnormal" speech burst is defined by the burst threshold.

Figure 5:
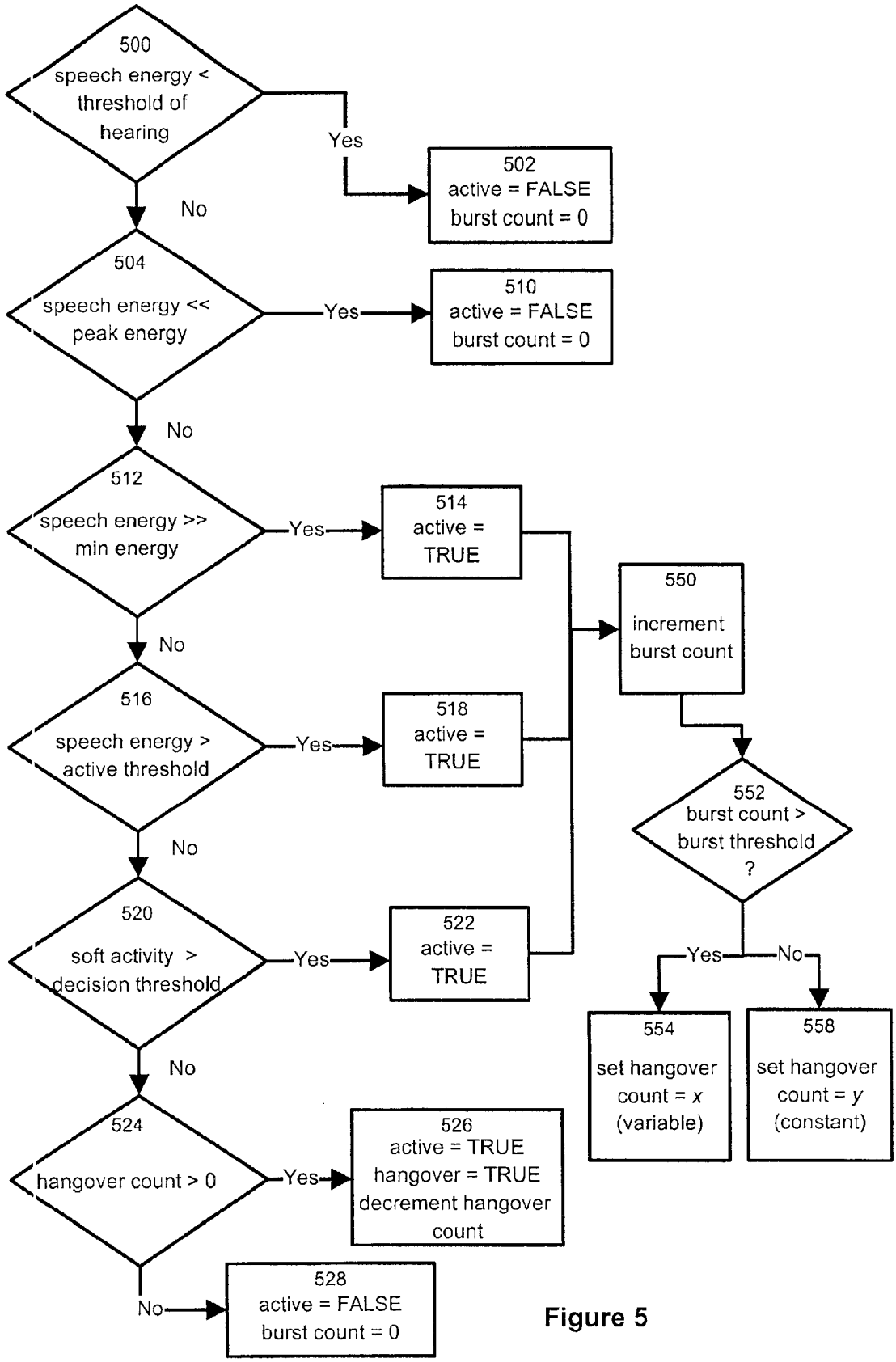
FIG. 5 is a flow diagram of the decision process of the voice activity detector of FIG. 4, in accordance with an example of implementation of the invention.

The VAD 204 makes use of the composite soft activity value 428, the speech energy 430, the output of the peak tracker 424 and the output of the minimum tracker 426 to determine the classification result 432 and the hangover identifier 434. In a typical interaction, as shown in the flow diagram of FIG. 5, the speech energy 430 is first tested against the threshold of hearing at step 500.

For the purpose of this specification, the expression "threshold of hearing" is used to designate the level of sound at which signals are inaudible. In a telecommunication context, this threshold is typically a function of the listener and the handset. In a specific example, the hearing threshold is set to −55 dBm.

If the current frame energy is below the threshold of hearing, the silent state is immediately entered and the frame is classified as not active, at step 502. The output of the VAD 204 in this case causes the switch 212 to interrupt the transmission of packets. Preferably, the VAD 204 also resets the burst count to zero, where the burst count keeps count of the duration of a speech burst. If condition 500 is answered in the negative, the speech energy 430 is compared against the peak energy 424 at step 504. If the speech energy 430 is much less that the peak energy 424, the background noise is most likely inaudible or relatively low. In a specific example, the speech energy 430 is considered to be much less than the peak energy 424 if it is about 40 dB below the peak energy 424. If the speech energy 430 is much less than the peak energy 424, step 504 is answered in the affirmative, the frame is classified as not active and the burst count is reset to 0. The output of the VAD 204 in this case causes the switch 212 to interrupt the transmission of packets.

If the speech energy 430 is not much less than the peak energy 424, step 504 is answered in the negative and condition 512 is tested. At step 512, if the speech energy 430 is much larger than the minimum background noise energy 426, the frame is classified as active at step 514. If condition 512 is answered in the negative, condition 516 is tested. At step 516, if the speech energy 430 is greater than a predetermined active threshold, the frame is classified as active at step 518. If condition 516 is answered in the negative, condition 520 is tested. If the composite soft activity value 428 is above a predetermined decision threshold, the speech frame is classified as active at step 522.

Specific to this example of implementation, the active threshold depends on the application of the voice activity detector 204, thresholds being chosen on the basis of a tradeoff between quality and transmission efficiency. If "bits" or bandwidth is expensive, the VAD 204 can be made more aggressive by setting a higher active threshold. Note that the voice quality at the signal receiver unit 154 may be affected under certain conditions.

When a frame is classified as active at steps 514, 518 or 522, the VAD 204 increments the burst count that keeps track of the duration of the consecutive speech burst in the input signal. At step 552, the burst count is compared to the burst threshold, where the value of this burst threshold is chosen based on experimental results. As will be discussed below, the burst threshold can be determined either for the setting of the variable-duration hangover period during a normal speech burst period or for the setting of the fixed-duration hangover period during an abnormal speech burst period.

If the burst count is above the burst threshold, the duration of the hangover period is set to x at step 554, where hangover period x is variable. In a specific example, the hangover period x bears a linear relationship to the estimated background noise level, and can be expressed as:

$$x = \frac{n_{\min} - h_{th}}{s_{th} - h_{th}} x_0 \quad \text{if} \quad \text{burst count} > \text{burst threshold}$$

where x is the hangover duration determined for the current frame, $x_0$ is the initial hangover period setting, $n_{min}$ is the output 426 of the minimum tracker 418 (which in the above equation is used as an estimation of the background noise energy), $h_{th}$ is the hearing threshold and $s_{th}$ is the active threshold.

The variable hangover period x is determined for each active speech frame, where a speech burst may include one or more active speech frames. However, the total variable hangover duration for a speech burst is actually only set up during processing of the final active speech frame in the speech burst. As can be seen from the above equation, the hangover period x becomes shorter when the background noise level $n_{min}$ decreases, and fewer frames of the passive audio information have to be transmitted to the receiver unit 154. When the background noise energy $n_{min}$ is close to the hearing threshold $h_{th}$, the hangover period x is very short since almost no passive audio information is required at the receiver unit 154. Such a variable-duration hangover period allows a reduction in the transmission rates of packets without affecting the quality of the sound at the signal receiver unit 154 when the background noise is such that it can be reproduced at the receiver unit 154. This results in a more efficient use of bandwidth when the background noise is weak.

At step 552, if the burst count is below the burst threshold, and thus exhibits abnormal characteristics, the duration of the hangover period is set to y at step 558. The hangover period y is fixed, set to a very small constant value, and its choice is based on the signal clipping behavior exhibited by the VAD 204 in a real-time environment.

Assume that, in a specific real-time implementation of the prior art system in which the VAD uses a pure variable hangover algorithm, the following signal clipping behavior was observed in the real-time environment:

- clipping occurred at the low-energy ends of speech bursts for the slightly longer unvoiced sounds such as [k] and [s];
- clipping occurred after 1 to 4 consecutive speech frames were detected as active speech (speech burst);
- consecutive clipping of the unvoiced portion was never greater than 2 frames, where the VAD operated on 10 ms frames.

Based on the above example of signal clipping behavior, the burst threshold of the VAD 204 according to the present invention could be set to 4 frames (40 ms) and the fixed-duration hangover period y of the VAD 204 to 2 frames (20 ms), in order to effectively eliminate signal clipping occurrences during voice activity detection. Note that many other settings of the burst threshold and the hangover period y are possible without departing from the scope of the present invention. Thus, when the input speech exhibits a burst duration that is less than the burst threshold, clipping of the low-energy endings with slightly longer unvoiced sounds is eliminated. An example is given by the word "six", for which the burst count is less than the burst threshold, where with only 2 frames (20 ms) of fixed-duration hangover period added to the ending portions of the fricative [k] and the sibilant [s], the clipping that was easily perceived under the prior art system is eliminated.

If at step 520 the composite soft activity value 428 is below the predetermined decision threshold, condition 524 is tested in order to determine if the hangover period has previously been set. If the hangover count is greater than zero, the speech frame is classified as active, the hangover state is set to TRUE and the hangover count is decremented, at step 526. Note that in this case, although the speech frame is classified as active, the speech frame would not be considered to be a burst of speech. If the hangover count is not greater than zero, the speech frame in classified as inactive at step 528 and the burst count is reset to 0.

The VAD 204, in accordance with the spirit of the invention, is applicable to most speech coders such as CELP-based speech coders. More specifically, parameters that are computed within the CELP coders may be used by the VAD 204, thereby reducing the overall complexity of the system. For example, most CELP coders compute a pitch period, where a pitch likelihood could be easily computed from this pitch period. Furthermore, line spectrum pair (LSP) differences can be used for a spectral non-stationarity measure rather than the likelihood ratio employed herein.

Figure 8:
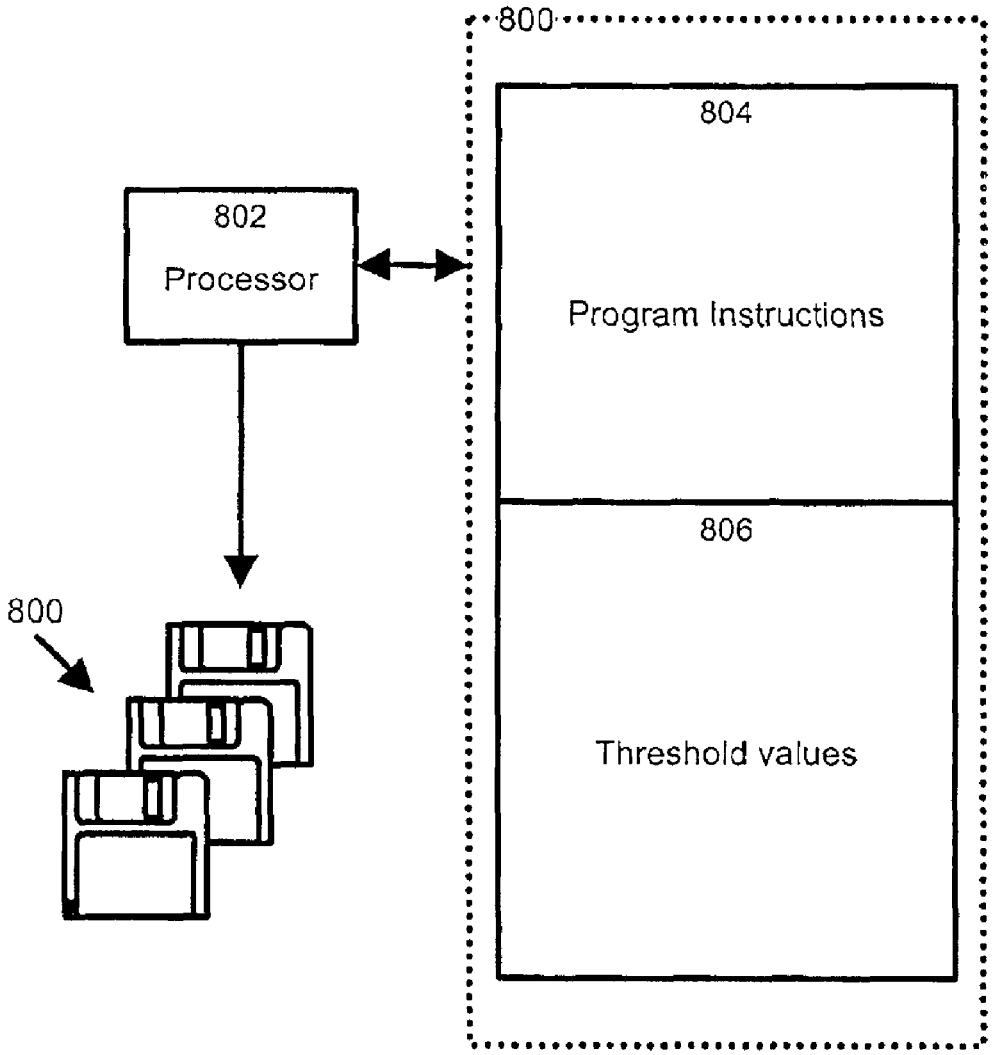
FIG. 8 shows an example of a computing platform for implementing the voice activity detector shown in FIG. 4.

The above-described method and apparatus for voice activity detection can be implemented in software on any suitable computing platform, the basic structure of such a computing device being shown in FIG. 8. The computing device has a Central Processing Unit (CPU) 802, a memory 800 and a bus connecting the CPU 802 to the memory 800. The memory 800 holds program instructions 804 for execution by the CPU 802 to implement the functionality of the voice activity detection system. The memory 800 also stores data 806, such as threshold values, that is required by the program instructions 804 for implementing the functionality of the voice activity detection system.

Alternatively, the signal transmitter and receiver units 154, 156 may be implemented on any suitable hardware platform. In a specific example, the signal transmitter unit 156 is implemented using a suitable DSP chip. Alternatively, the signal transmitter unit 156 can be implemented using a suitable VLSI chip. The use of hardware modules differing from the ones mentioned above does not detract from the spirit of the invention.

Although the present invention has been described in considerable detail with reference to certain preferred embodiments thereof, variations and refinements are possible without departing from the spirit of the invention as have been described throughout the document. Therefore, the scope of the invention should be limited only by the appended claims and their equivalents.

I claim:

1. A voice activity detection apparatus, comprising:

a) an input for receiving an input signal derived from audio information, the input signal including a plurality of frames, each frame containing either one of active audio information and passive audio information;

b) a processing functional block coupled to said input for processing the input signal for generating an output signal capable to acquire at least two possible states, namely a first state and a second state, said first state being indicative of an input signal containing active audio information, said second state being indicative of an input signal containing passive audio information, said processing functional block being operative to:

i) for one or more frames received at said input and containing active audio information, compute a hangover time period, the computation including determining whether the hangover time period has a fixed duration or a variable duration, the determining being done on the basis of characteristics of the active audio information contained in the one or more frames;

ii) detecting a frame received at said input subsequently to the one or more frames containing the active audio information, that contains passive audio information; and iii) causing the output signal to acquire said second state after the expiry of the computed hangover time period from the detecting of the frame containing the passive audio information.

2. A voice activity detection apparatus as defined in claim 1, wherein determining whether the hangover time period has a fixed duration or a variable duration is based on the duration of the active audio information contained in the one or more frames.

3. A voice activity detection apparatus as defined in claim 2, wherein if the duration of the active audio information contained in the one or more frames is less than a burst threshold, said hangover time period has a fixed duration.

4. A voice activity detection apparatus as defined in claim 3, wherein the fixed duration of said hangover time period is set to a predetermined constant value y.

5. A voice activity detection apparatus as defined in claim 3, wherein if the duration of the active audio information contained in the one or more frames is greater than the burst threshold, said hangover time period has a variable duration.

6. A voice activity detection apparatus as defined in claim 5, wherein the variable duration of said hangover time period is a function of the duration of the active audio information contained in the one or more frames.

7. A voice activity detection apparatus as defined in claim 6, wherein the one or more frames containing active audio information are characterised by a background noise energy level, whereby the variable duration of said hangover time period is further a function of said background noise energy level.

8. A voice activity detection apparatus as defined in claim 1, wherein said processing functional block is operative to compute a classification data element for each frame of said input signal, the classification data element for a certain frame being indicative of whether the certain frame contains active audio information or passive audio information, a current state of the output signal being dependent at least in part on the basis of classification data elements computed with relation to previously received frames of the input signal.

9. A voice activity detection apparatus as defined in claim 8, wherein the classification data element is computed at least in part on the basis of a non-stationarity likelihood value associated with the certain frame.

10. A method for performing voice activity detection comprising:

a) receiving an input signal derived from audio information, the input signal including a plurality of frames, each frame containing either one of active audio information and passive audio information;

b) processing the input signal for generating an output signal capable to acquire at least two possible states, namely a first state and a second state, the first state being indicative of an input signal containing active audio information, the second state being indicative of an input signal containing passive audio information, the processing including:

i) for one or more frames received and containing active audio information, computing a hangover time period, the computing including determining whether the hangover time period has a fixed duration or a variable duration on the basis of characteristics of the active audio information contained in the one or more frames;

ii) detecting a frame received at said input subsequently to the one or more frames containing active audio information, that contains passive audio information; and iii) causing the output signal to acquire the second state after the expiry of the computed hangover time period from the detecting of the frame containing passive audio information.

11. A method as defined in claim 10, wherein determining whether the hangover time period has a fixed duration or a variable duration is based on the duration of the active audio information contained in one or more frames.

12. A method as defined in claim 11, wherein if the duration of the active audio information contained in the one or more frames is less than a burst threshold, the hangover time period has a fixed duration.

13. A method as defined in claim 12, wherein the fixed duration of the hangover time period is set to a predetermined constant value y.

14. A method as defined in claim 12, wherein if the duration of the active audio information contained in the one or more frames is greater than the burst threshold, the hangover time period has a variable duration.

15. A method as defined in claim 14, wherein the variable duration of the hangover time period is a function of the duration of the active audio information contained in the one or more frames.

16. A method as defined in claim 15, wherein the variable duration of the hangover time period is further a function of a background noise energy level in the one or more frames.

17. A voice activity detection apparatus, comprising:

a) input means for receiving an input signal derived from audio information, the input signal including a plurality of frames, each frame containing either one of active audio information and passive audio information;

b) processing means for processing the input signal for generating an output signal capable to acquire at least two possible states, namely a first state and a second state, said first state being indicative of an input signal containing active audio information, said second state being indicative of an input signal containing passive audio information, said processing means being operative to:

i) for one or more frames received at said input means and containing active audio information, compute a hangover time period, the computation including determining whether the hangover time period has a fixed duration or a variable duration, the determining being done on the basis of characteristics of the active audio information contained in the one or more frames;

ii) detecting a frame received at said input means subsequently to the one or more frames containing the active audio information, that contains passive audio information; and iii) causing the output signal to acquire said second state after the expiry of the computed hangover time period from the detecting of the frame containing the passive audio information.

* * * * *